US009628920B2

(12) United States Patent
Bach et al.

(10) Patent No.: US 9,628,920 B2
(45) Date of Patent: Apr. 18, 2017

(54) VOLTAGE GENERATOR AND BIASING THEREOF

(71) Applicant: Infineon Technologies AG, Neubiberg (DE)

(72) Inventors: Elmar Bach, Villach (AT); Christian Ebner, Munich (DE)

(73) Assignee: Infineon Technologies AG, Neubiberg (DE)

( * ) Notice: Subject to any disclaimer, the term of this patent is extended or adjusted under 35 U.S.C. 154(b) by 202 days.

(21) Appl. No.: 14/516,306

(22) Filed: Oct. 16, 2014

(65) Prior Publication Data

US 2016/0111954 A1 Apr. 21, 2016

(51) Int. Cl.

| | |
|---|---|
| ***G05F 1/10*** | (2006.01) |
| ***G05F 3/02*** | (2006.01) |
| ***H04R 19/04*** | (2006.01) |
| ***H04R 3/00*** | (2006.01) |

(52) U.S. Cl.

CPC ..... *H04R 19/04* (2013.01); *H04R 3/00* (2013.01); *H04R 2201/003* (2013.01)

(58) Field of Classification Search

CPC ..... H02M 3/07
USPC ..... 327/536; 381/111
See application file for complete search history.

(56) References Cited

U.S. PATENT DOCUMENTS

| | | | |
|---|---|---|---|
| 6,406,956 | B1 | 6/2002 | Tsai et al. |
| 7,075,127 | B2 | 7/2006 | Kothandaraman et al. |
| 7,098,721 | B2 | 8/2006 | Ouellette et al. |
| 7,187,611 | B2 | 3/2007 | Chen |
| 7,977,754 | B2 | 7/2011 | Chuang et al. |
| 8,035,191 | B2 | 10/2011 | Lin et al. |
| 8,294,239 | B2 | 10/2012 | Min |
| 8,299,570 | B2 | 10/2012 | Kim et al. |
| 8,377,790 | B2 | 2/2013 | Kanike et al. |
| 8,666,095 | B2 | 3/2014 | Hanzlik et al. |
| 2006/0065946 | A1 | 3/2006 | Mehrad et al. |
| 2006/0157819 | A1 | 7/2006 | Wu |
| 2008/0007323 | A1* | 1/2008 | Caplan ..... H03K 19/0013 327/536 |

(Continued)

FOREIGN PATENT DOCUMENTS

| | | | |
|---|---|---|---|
| DE | 112009001037 | T5 | 7/2011 |
| DE | 102013207975 | A1 | 10/2013 |

OTHER PUBLICATIONS

"One-Time Programmable Storage," Sidense Corp., http://www-wsidense.com/technology.html., retrieved Oct. 16, 2014, 2 pages.

(Continued)

*Primary Examiner* — Lincoln Donovan
*Assistant Examiner* — Metasebia Retebo
(74) *Attorney, Agent, or Firm* — Slater Matsil, LLP

(57) ABSTRACT

In accordance with an embodiment of the present invention, a method of operating a voltage generator includes providing a bypass switch to bypass a ripple filter coupled to a power converter. A coupling capacitor includes a first plate and a second plate. The first plate is coupled to a control node of the bypass switch. A bypass control signal is received. The control node of the bypass switch is toggled between a first voltage to a second voltage different from the first voltage by toggling the second plate of the coupling capacitor based on the bypass control signal.

31 Claims, 12 Drawing Sheets

(56) References Cited

U.S. PATENT DOCUMENTS

| | | | | |
|---|---|---|---|---|
| 2010/0246859 | A1* | 9/2010 | David | G05F 1/467 381/120 |
| 2013/0043972 | A1* | 2/2013 | Wu | H01L 23/5256 337/297 |
| 2013/0051582 | A1 | 2/2013 | Kropfitsch et al. | |
| 2013/0287231 | A1* | 10/2013 | Kropfitsch | H02M 3/073 381/113 |
| 2014/0191732 | A1 | 7/2014 | Tseng et al. | |

OTHER PUBLICATIONS

IEEE Journal of Solid-States Circuits, vol. SC-11, No. 3., Jun. 1976, Dickson, J.F., On-Chip high-voltage generation of MNOS integrated circuits using an IFAG LP P, Jun. 1976, 6 pages.

* cited by examiner

VOLTAGE GENERATOR AND BIASING THEREOF

TECHNICAL FIELD

The present invention relates generally to voltage generators, and, in particular embodiments, to an apparatus and methods for biasing voltage generators.

BACKGROUND

Audio microphones are commonly used in a variety of consumer applications such as cellular telephones, digital audio recorders, personal computers and teleconferencing systems. In particular, lower-cost electret condenser microphones (ECM) are used in mass produced cost sensitive applications. An ECM microphone typically includes a film of electret material that is mounted in a small package having a sound port and electrical output terminals. The electret material is adhered to a diaphragm or makes up the diaphragm itself. Most ECM microphones also include a preamplifier that can be interfaced to an audio front-end amplifier within a target application such as a cell phone. Another type of microphone is a microelectro-mechanical Systems (MEMS) microphone, which can be implemented as a pressure sensitive diaphragm is etched directly onto an integrated circuit. The MEMS sensor is typically implemented on a separate die. In combination with an ASIC on another die, a MEMS package is assembled by putting both chips into a single acoustic package. In modern microphones, a MEMS sensor is combined with application specific circuit (ASIC) in a single acoustic package with the ASIC performing the readout of the signal delivered by the MEMS and communication with the external world in either an analog manner (so called analog silicon microphones) or by involving an analog-to-digital conversion and exchanging digital data (digital silicon microphones), e.g., with a Codec unit on a mobile device.

Environmental sound pressure levels span a very large dynamic range. For example, the threshold of human hearing is at about 0 dBSPL, conversational speech is at about 60 dBSPL, while the sound of a jet aircraft 50 m away is about 140 dBSPL. MEMS microphone may be carefully designed and constructed to withstand high intensity acoustic signals and faithfully convert these high intensity acoustic signals into an electronic signal.

Besides performance, another important factor relates to production costs. Conventional ASIC of silicon microphones may use a number of non-standard or special components that increase the unit cost. For example, high voltage components if used can increase the cost of the final product significantly A 'standard CMOS process' is a process including core devices for logic designs and devices for I/O handling, the latter able to handle a maximum of 3.6 V. Accordingly, standard CMOS devices include core devices and I/O devices, for example, which may be devices with thicker gate oxides.

SUMMARY

In accordance with an embodiment of the present invention, a method of operating a voltage generator comprises providing a bypass switch to bypass a ripple filter coupled to a power converter. A coupling capacitor comprising a first plate and a second plate is provided. The first plate is coupled to a control node of the bypass switch. A bypass control signal is received. The control node of the bypass switch is toggled between a first voltage to a second voltage different from the first voltage by toggling the second plate of the coupling capacitor based on the bypass control signal.

In accordance with an alternative embodiment of the present invention, a voltage generator comprises a multi-stage charge pump circuit comprising a high voltage output node to output a high voltage and an intermediate voltage output node to output an intermediate voltage. A ripple filter is coupled between the high voltage output node of the multi-stage charge pump circuit and an output node of the voltage generator. A bypass switch is coupled to the ripple filter. The bypass switch is coupled between the high voltage output node of the multi-stage charge pump circuit and the output node of the voltage generator. The voltage generator further comprises a capacitive coupling circuit to enable and disable the bypass switch. The capacitive coupling circuit is coupled to the multi-stage charge pump circuit in a high voltage regime, and configured to receive a bypass control signal in a low voltage regime.

In accordance with an alternative embodiment of the present invention, an electronic device comprises a voltage generator configured to output a voltage higher than a supply voltage at an output node. All devices in the voltage generator comprise standard CMOS devices. A MEMS microphone is coupled to the output node of the voltage generator.

BRIEF DESCRIPTION OF THE DRAWINGS

For a more complete understanding of the present invention, and the advantages thereof, reference is now made to the following descriptions taken in conjunction with the accompanying drawings, in which:

FIGS. 3A and 3B illustrate well design between adjacent wells, wherein FIG. 3A illustrates a conventional design and FIG. 3B illustrates an embodiment of the invention to avoid lateral breakdown between adjacent wells by increasing the isolation distance between the wells;

FIGS. 9A and 9B illustrate an embodiment of silicon microphones with MEMS acoustic sensors, wherein FIG. 9A illustrates a digital silicon microphone whereas FIG. 9B illustrates an analog silicon microphone.

DETAILED DESCRIPTION OF ILLUSTRATIVE EMBODIMENTS

Embodiments of the present invention teach capacitive coupling (AC coupling) instead of DC coupling to steer a bypass of the output ripple filter that is located in the high voltage domain of a high bias voltage generator. Thereby high-voltage technologies capable of handling voltage levels exceeding 5 V, like CMOS Flash or DeMOS, are no longer required in the design of the voltage generator. As described further below, using embodiments of the present invention all components of the high voltage bias generator can be designed without using high voltage technology.

By having solved this bottleneck of the high bias voltage generator embodiment of the present invention enables using standard CMOS technology. The significant reduction in process layers and corresponding processing results in a distinctive saving in production cost.

Embodiments of the present invention may implement the capacitive coupling scheme differently. However, such embodiments may follow the general concept of charging a capacitor and steering the control node of a bypass device by changing the voltage at the bottom plate of the capacitance.

Figure 1:
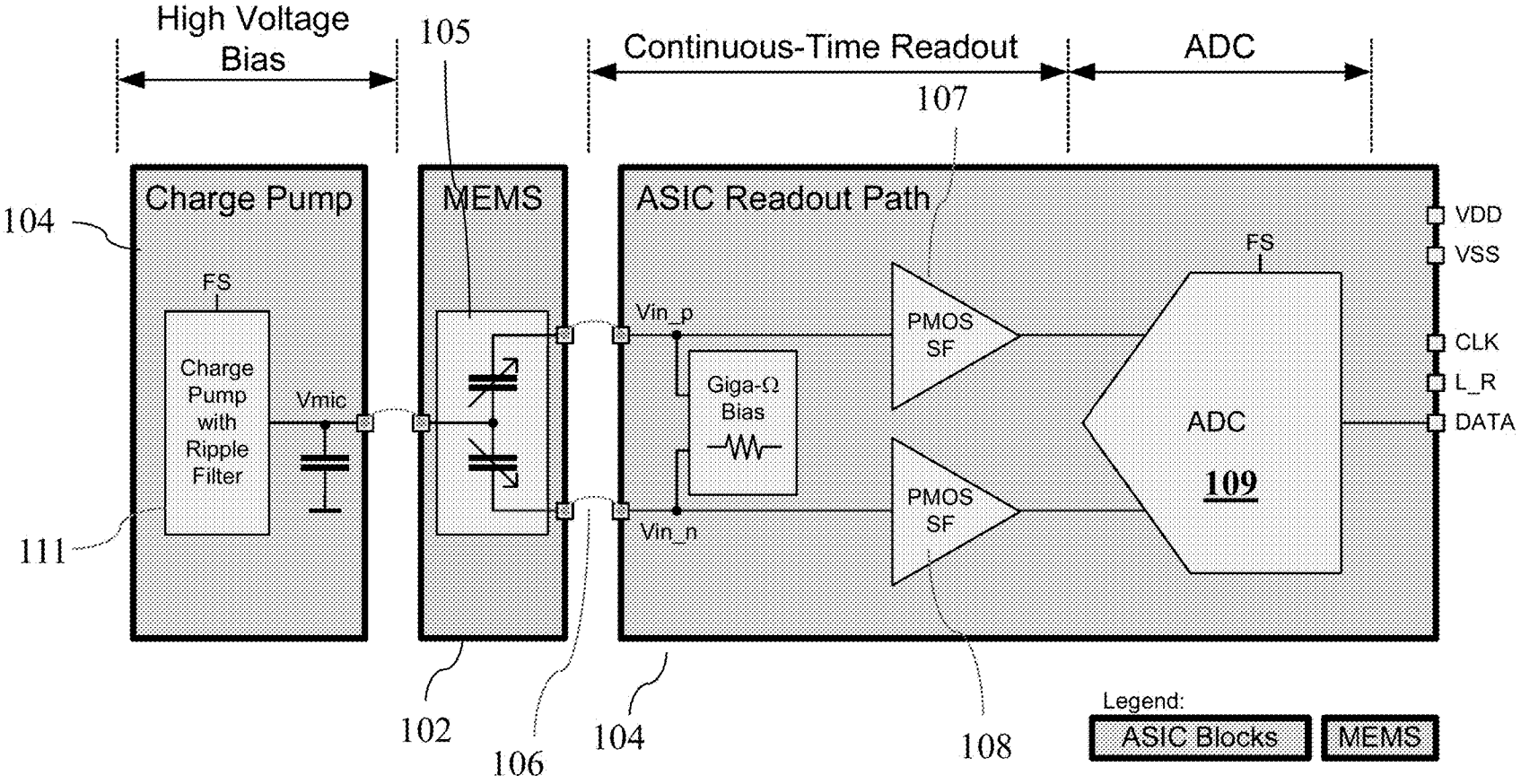
FIG. 1 illustrates the integrated circuits blocks of a digital silicon microphone comprising of a MEMS sensor and an ASIC.

FIG. 1 illustrates the integrated circuits blocks of a MEMS microphone.

The MEMS microphone includes two blocks a MEMS block 102 and an ASIC block 104. The MEMS block 102 is electrically coupled to the ASIC block 104, for example, may be packaged together as a single component and may not be necessarily included in a single integrated circuit (IC). Further, the ASIC block 104 may be a single chip or multiple chips in various embodiments. In some embodiments, MEMS block 102 may also be included on an IC (along with the ASIC block 104) or on a separate die housed within the same package. In alternative embodiments, other microphone types, such as ECM microphones, or other types of capacitive sensor circuits may be used in place (or in combination with) of the MEMS microphone in the MEMS block 102.

The ASIC block 104 includes all the associated circuitry for operating the MEMS device 105 in the MEMS block 102. The ASIC block 104 produces the bias voltage Vmic for the MEMS device 105. Accordingly, the ASIC block 104 includes a charge pump circuit for applying a high voltage Vmic on the MEMS block 102, and a readout path 106 for measuring the output from the MEMS device 105. The ASIC block 104 includes a high bias voltage generator and provides programmable voltage levels exceeding the supply voltage VDD, e.g. from ~3 V to ~15 V to the MEMS block 102. The readout path 106 receives the differential signal from the MEMS device 105 and amplifies it using source follower amplifiers 107 and 108 comprising PMOS transistors, which is then converted to a digital signal using an ADC 109. Subsequent processing of the signal may be performed as in conventional signal processing of the MEMS device out. The ASIC block 104 may further include a voltage regulator coupled to the VDD pin and may provide a constant fixed supply voltage to the charge pump 111 and the ADC 109.

Voltage generators for voltages exceeding VDD are commonly designed using charge-pump circuitry that operates on a provided clock FS, which may be synced with the ADC 109. Charge pump designs are standard building blocks and a suitable approach can be selected from conventional designs.

Referring to FIG. 1, the output from the programmable high bias voltage Vmic is typically in the range from 3 V to 15 V, which exceeds the supply voltage VDD. The high voltage input is generated by the ASIC block 104 and applied on the MEMS device within the MEMS block 102.

High bias voltages are often used for calibration, as an example, to determine the sensitivity of the microphone. For example, the diaphragm of the MEMS device 105 may be charged to the high bias voltage while both back plates are biased at a relatively low voltage level determined by the ASIC readout path, e.g. 0.5 V. The programming codes for the testing as well as results from the calibration are stored in a non-volatile storage memory. The calibration may be performed during a factory setup, during initial startup, or in user mode. However, typically, calibration can be performed only after the assembly. In the above example, the full microphone comprising the MEMS block 102 and the ASIC block 104 is calibrated in the acoustic package.

Conventional high bias voltage generator use high voltage devices that are fabricated using different process technologies such as CMOS EEPROM technologies (Flash) or Drain-Extended MOS (DeMOS) technologies. These technologies are much more expensive than standard CMOS process technologies because of a significantly higher number of processing steps to incorporate, e.g., the thick-oxide, high-voltage devices of an EEPROM cell.

In various embodiments, the present invention overcomes these and other problems as described further below in the design of high bias voltage generator for use in various applications, e.g., silicon microphones comprising one or more MEMS capacitive sensors and an ASIC.

In various embodiments, a high bias voltage is generated with a charge pump without the use of expensive high voltage devices. To enable the above, circuit areas holding higher voltages are separated from circuits holding low-voltage devices. Voltage ripples in the output of the charge pump are removed using a ripple filter. The fast startup time for the MEMS microphone device are achieved by the use of a switch to bypass the ripple filter and associated switch control circuitry using standard CMOS devices. Programming codes after assembly are stored in a non-volatile storage such as an eFuse technology described further below, which does not require high-voltages for operation during memory readout.

In various embodiments, the high bias voltage generators are loaded by very small currents, e.g. leakage currents. In various embodiments, the high bias voltage generator is designed using a standard CMOS technology offering a cost saving option to the overall system. Conventionally, the control circuitry of the bypass switch is implemented using high-voltage devices. In one or more embodiments, the control circuitry of the bypass switch is implemented in a standard CMOS process without high-voltage devices thus enabling standard CMOS technology for the whole high bias voltage generator.

Figure 2:
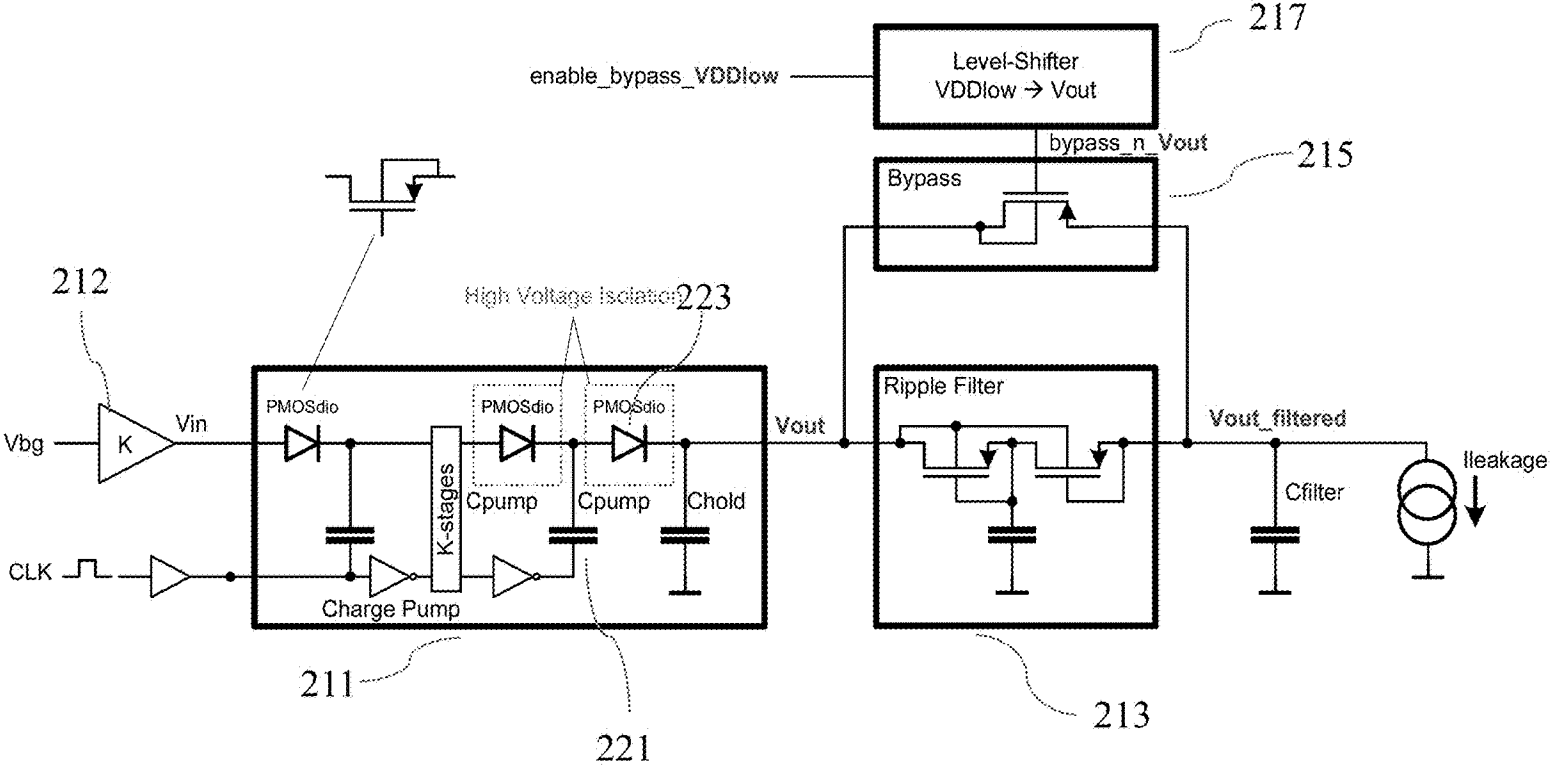
FIG. 2 illustrates a basic block diagram of a conventional high-voltage bias generator for a MEMS microphone.

FIG. 2 illustrates a basic block diagram of a conventional high-voltage bias generator.

The high voltage bias generator comprises a charge pump 211, a ripple filter 213, and a bypass switch 215 that is controlled by a level shifter 217. The charge pump receives an input voltage Vin, e.g., through an OpAmp 212 and a clock signal that may be synchronized with the ADC and other blocks in the ASIC block. The output is loaded by a leakage current small enough to cause only a small offset from Vout to Vout_filtered of approximately a few 10 mV.

The level shifter 217 steering the bypass switch 215 ensures that the gate potential of the bypass switch 215 (e.g., a stack of one or more PMOS transistors configured as diodes) is tied to the output voltage (Vout) of the charge pump 211. Due to the leakage current (Ileakage) the output voltage (Vout_filtered) of the ripple filter 213 is lower than the output voltage of the charge pump 211. Thereby the bypass switch 215 can be fully turned off by connecting the gate to the output voltage of the charge pump 211 and such that the impedance of the bypass switch 215 can be made much higher than the impedance of the slightly forward biased PMOS diode ripple filter. Typically, in conventional designs, the gate of the bypass switch 215 is switched to VSS if the bypass is engaged. This applies a high voltage across the gate dielectric of the bypass switch 215. To prevent failure of the bypass switch 215, conventional designs use a sufficiently thick gate oxide to sustain the high voltage differences, e.g. devices available in a CMOS Flash process.

Having the CMOS Flash technology allows use of MOS capacitors in the pumping stages too. But because of the large gate oxide thickness, the area specific capacitance is relatively small. Thus, in conventional designs, a larger amount of layout space has to be spent for the pump, hold and filter capacitors. The larger foot print required by such capacitors increases the product costs.

In various embodiments of the present invention, metal capacitors are used to support voltages exceeding 20 V while using similar or even less layout area than thick gate-oxide MOS capacitor based designs.

Charge pumps can be designed by a series of pumping stages that typically comprise of a pump capacitor 221 and a diode or a MOSFET diode 223 to couple between adjacent stages and which may be operating on different clock phases. The stacked approach keeps the voltage difference between adjacent stages small enough such that no special process technology is required.

Because of the relatively small voltage steps between adjacent pump stages it is common to use PMOS devices in local n-wells thereby offering isolation between the stages and towards other circuit parts. However, as the voltage increases during subsequent stages of the charge pump, a large potential difference is generated between the increasingly higher voltage generated and VSS. This requires a stronger isolation (illustrated as high voltage isolation in FIG. 2) than possible by just the use of standard process comprising of n-wells separated by complementary doped p-wells, both wells located in a common lowly p-doped substrate.

Figure 3A:
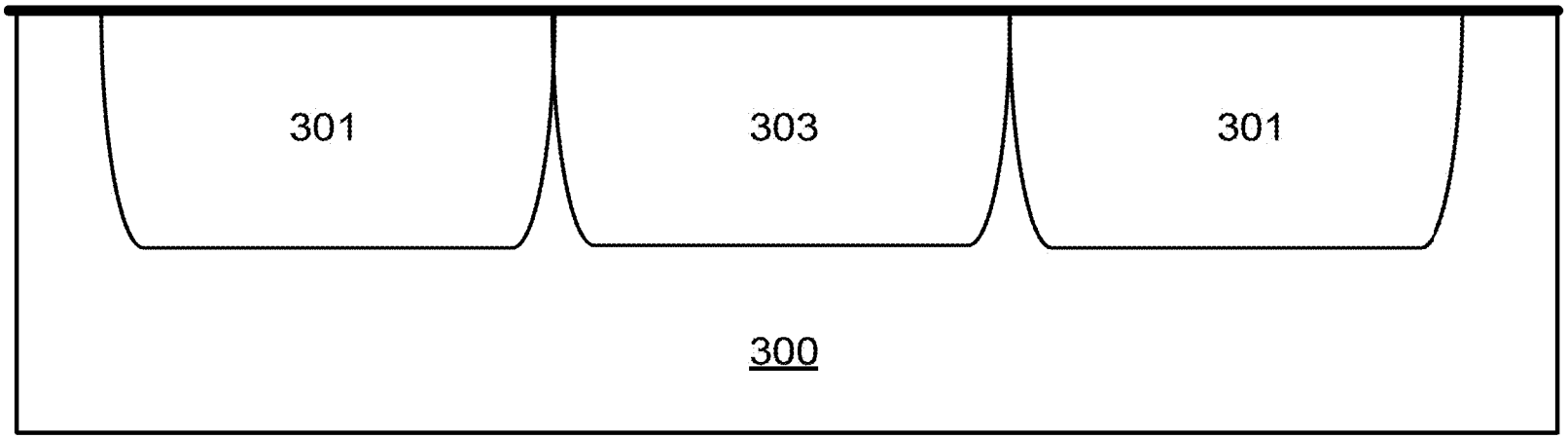
Figure 3A PRIOR ART

Therefore, as illustrated in FIG. 3A, a standard process comprises n-wells 301 surrounded by p-well 303 and located in a lowly p-doped substrate 300. Thus providing isolation between the n-wells 301 comprising the pump stages. Nevertheless, if the voltage in the pumping stages exceeds ~5 V then simple n-wells 301 that are closely surrounded by a p-well 303 no longer provide adequate isolation.

Figure 3B:
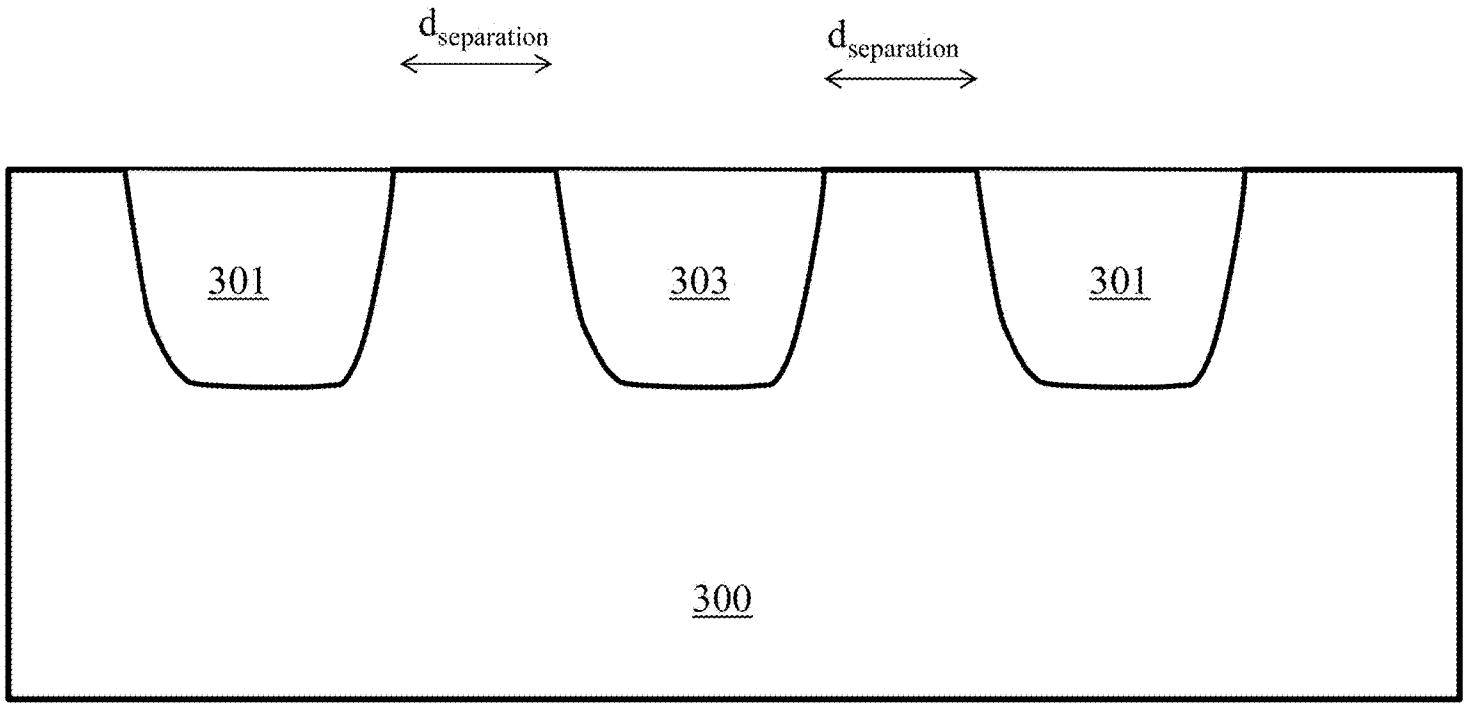

FIG. 3B illustrates an additional gap that is commonly used to avoid lateral breakdown.

A separation of the high-doped n-wells 301 and p-wells 303 is obtained by a low-doped p-type material, e.g., the p-substrate 300 of the CMOS process. The lateral breakdown voltage is a function of the doping and the introduced gap distance $d_{separation}$. Separation distances of about 1 μm may be sufficient for isolations of voltages exceeding 20 V. Without the separation, the diode breakdown is about 5 V and therefore the charge pump breaks down prior to reaching output voltage. Advantageously, this lateral isolation does not require additional mask levels or even processing steps. The space between the existing n-wells 301 and p-wells 303 may be modified according to the isolation requirements.

Clocked charge pumps produce an undesired voltage ripple at the clock frequency (or a multiple of the clock frequency) that is superimposed to the high output voltage. Often it is required to filter this voltage ripple. In applications in which the bias voltage noise can add to the system noise, this ripple has to be filtered to the maximum possible content. Filtering is therefore done with the highest possible attenuation, i.e., using the lowest possible corner frequency for the ripple filter.

Referring back to FIG. 2, conventional ripple filters may be designed by a stack of two PMOS diodes that are implemented in a common n-well which is connected to output node Vout of the charge pump 211. This node is driven with the relatively low output impedance of the charge pump 211 such that a leakage from the n-well to VSS can be ignored at the output. Such designs have ripple filters with output impedances in the Giga-Ohm range. Thus a small filter capacitance $C_{filter}$ around 10 pF can be sufficient for implementation of ripple filters with corner frequencies below 10 Hz.

However, a permanent ripple filter would cause excessive startup times. For example, charging of the MEMS device e.g., having a capacitance of 3-5 pF to a voltage level of 10 V may be within 10 ms. The ripple filter 213 if active can degrade the startup behavior. Therefore, a common solution is to shunt the ripple filter during startup using the bypass switch 215. Once the output voltage is settled, the bypass switch 215 is shut-off and the full ripple suppression is provided by the low corner frequency ripple filter 213. Voltage ripples during startup are insignificant and therefore the ripple filter may be inactive during start-up.

The bypass function and therefore the bypass switch 215 operate at a high voltage level. To dynamically engage and disengage the bypass option, conventional designs use high-voltage technologies that allow level shifter implementations to steer the bypass switch function.

Figure 4:
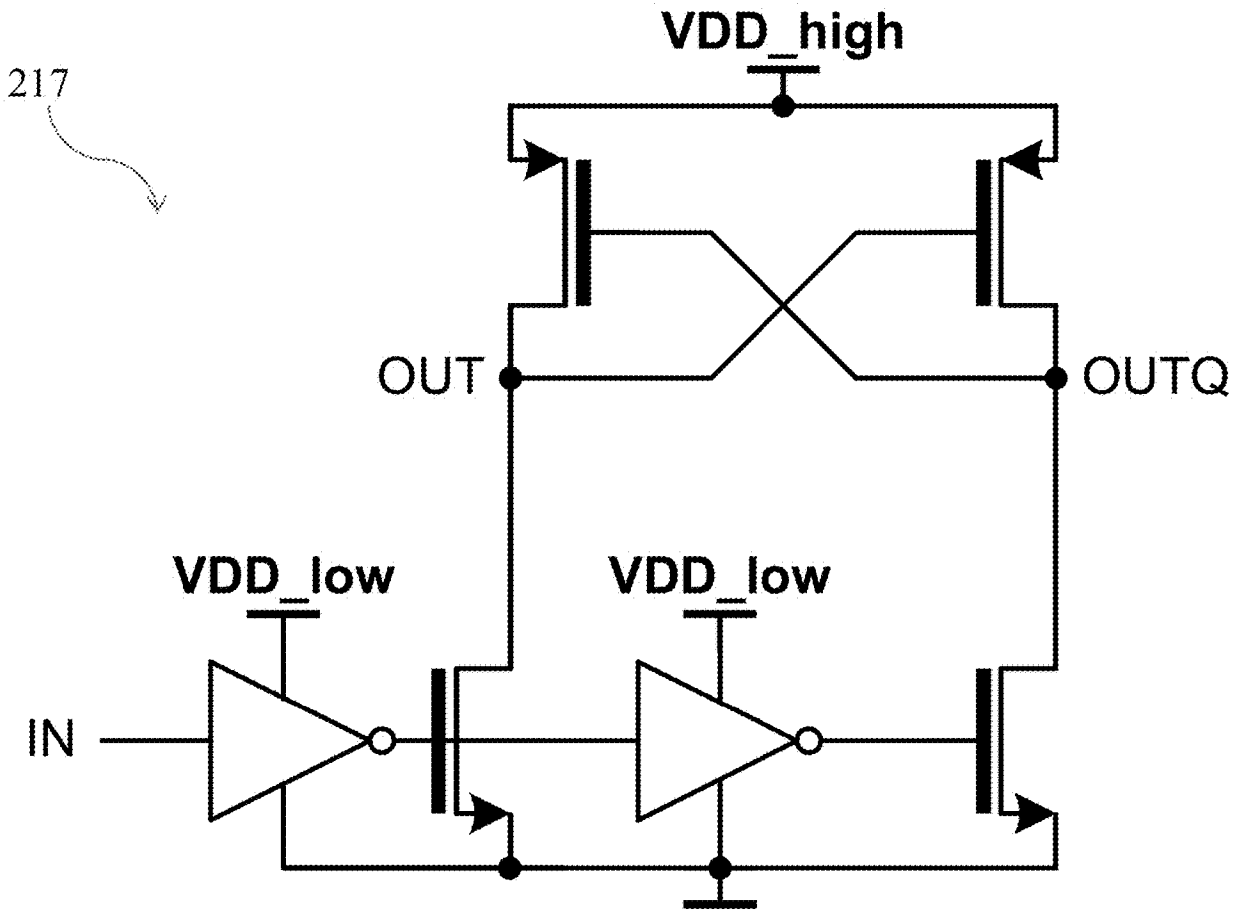
FIG. 4 illustrates an example level shifter for operating the bypass switch using conventional designs.

FIG. 4 illustrates a level shifter for operating the bypass switch using conventional designs.

The level shifter 217 (see also FIG. 2) may be a standard level-shifter comprising cross-coupled PMOS transistors implemented using, for example, CMOS Flash technology. CMOS Flash technology offers as part of the EEPROM Cell devices with very thick gate oxide e.g. 25 nm, long channel length and special implants such that those devices can sustain voltages exceeding, e.g., 25 V across all terminals, i.e., gate-to-source or drain-to-source. Other technology options include drain-extended MOSFETs (DeMOS) devices, which can sustain high drain-to-source voltages by special design of the MOSFET device but are typically limited regarding the maximum gate-to-source voltage. Accordingly, conventional designs for level shifter 217 use Flash or DeMOS devices for sustaining high voltage operation.

Both CMOS Flash and DeMOS technologies offer storage capabilities and are therefore used in conventional designs for non-volatile storage. The Flash process uses EEPROM cells while the DeMOS process uses electrical fuse (eFuse).

Thus, high voltage technologies are used in conventional designs for high bias voltage generators, voltage pumping and isolation, ripple suppression, fast bypass, and non-volatile storage of programming data. However, high voltage technologies significantly add to production cost.

Embodiments of the present invention avoid using high voltage technologies by using a combination of designs carefully selected to avoid the need for using high voltage designs. Embodiments of the present invention avoid the use of high voltage technology (Flash or DeMOS). Embodiments of the present invention address designs relating to design of the level shifter that is steering the bypass option, and storing of programming data.

In one or more embodiments, storing of programming data may be accomplished using eFuses, which may be poly silicon resistors that have been formed by blowing a narrow salicided (self-aligned silicide) poly silicon resistor due to rupture, agglomeration, or electro-migration of the salicide. The remaining poly silicon resistor forms a higher ohmic resistor device compared to an un-blown low-ohmic reference device (a salicided poly resistor). Programming can be done on a packaged device. Accordingly, in various embodiments, non-volatile memory is programmed in-package using an eFuse designed according to a standard CMOS technology.

The other components of the voltage generator may be formed using standard CMOS components as detailed further below.

In the charge pump 211, metal capacitors may be used for voltage pumping. The metal capacitors may be formed as lateral metal capacitors (two adjacent metal lines in the same metal level rather than on different metal levels), which help to form capacitors at a lower foot print without compromising the capacitance. The lateral metal capacitors advantageously have higher capacitance because the metal lines in the same metal level may be made closer without violating design rules than metal lines in adjacent (vertical) metal levels.

MOSFET diodes 223 (PMOS diodes or PMOS switches) within local n-wells are used for pump stage coupling of charge pump 211. Similarly, the ripple filter 213 uses PMOS diodes in a standard CMOS technology.

As described using FIG. 3, lateral isolation of high voltages within the charge pump 211 is obtained using a standard CMOS process (without additional cost) by adding separation space between adjacent n-wells 301 and p-wells 303 (FIG. 3).

Figure 5:
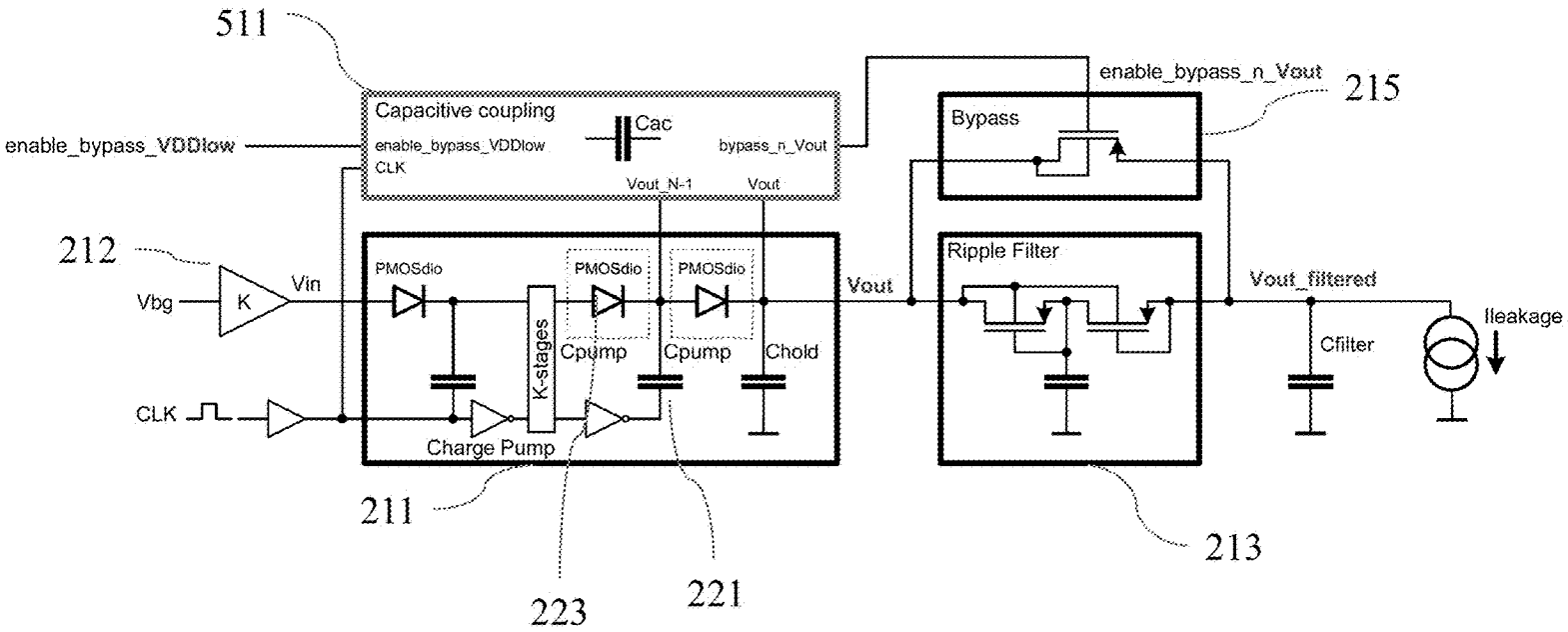
FIG. 5 illustrates a schematic of a high bias voltage generator with output ripple-filter bypass switch controlled by capacitive coupling in accordance with an embodiment of the present invention.

FIG. 5 illustrates a schematic of a high bias voltage generator with output ripple-filter bypass switch controlled by capacitive coupling in accordance with an embodiment of the present invention.

In various embodiments, capacitive coupling (AC coupling) is used to couple to the gate of the bypass switch instead of DC coupling (level shifting). As will be described further below, using such a capacitive coupling enables the use of low voltage devices.

Referring to FIG. 5, the capacitive coupling unit 511 receives the bypass control signal enable_bypass_VDDlow and the clock input CLK in the low-voltage domain as well as the output voltage Vout of the charge pump 211 and the input voltage Vout_N−1 of the highest pump stage in the high voltage domain. In other embodiments, other stages of the charge pump may also be used, for example, lower stage output corresponding to Vout_N−2, Vout_N−3, or others.

As an illustration of the operation of the capacitive coupling unit 511, if the input enable_bypass_VDDlow is set to '0', then the gate of the bypass transistor is charge-pumped to Vout. Otherwise, if the input enable_bypass_VDDlow is set to '1', then the AC coupling toggles the gate of the bypass switch 215 between Vout and a voltage below Vout, which is sufficient to turn-on the bypass switch 215. Thus a periodic pattern is generated at the gate of the bypass switch 215. It is not mandatory but beneficial to align the frequency of the coupling pattern with the operation frequency of the charge pump 211.

Figure 6:
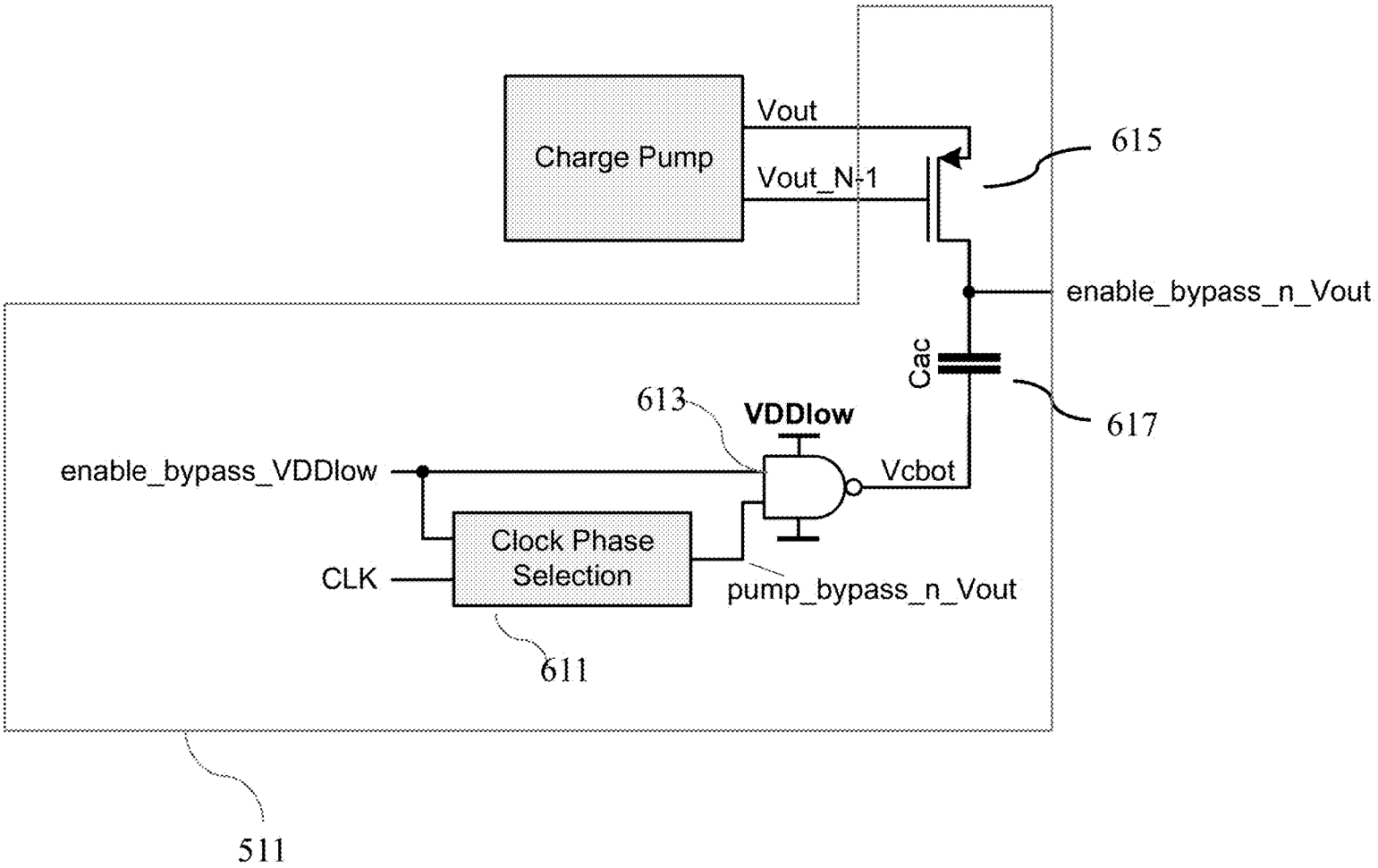
FIG. 6 illustrates a simplified circuit diagram of an implementation of the capacitive coupling unit in accordance with embodiment of the present invention.

FIG. 6 illustrates a simplified circuit diagram of an implementation of the capacitive coupling unit in accordance with an embodiment of the present invention.

Referring to FIG. 6, the capacitive coupling unit 511 comprises a transistor 615 coupled to a coupling capacitor 617. The gate of the transistor 615 is coupled to the N−1 stage output of the charge pump 211.

In alternative embodiments, any voltage output within the charge pump chain may be selected that toggles a voltage properly between two voltage levels, for example, Vout and a lower voltage level. In an alternative embodiment, a voltage internal to the last charge pump stage may be used. For example, this stage may use a switching structure rather than a simple PMOS diode to couple a pumped voltage to the output.

The capacitive coupling unit 511 further comprises a clock phase selection unit 611 that is configured to receive an enable_bypass_VDDlow and a CLK signal and output a pump_bypass_n_Vout signal indicating whether the bypass switch 215 (FIG. 5) is to be activated or deactivated. The pump_bypass_n_Vout is received at a NAND gate 613, whose output switches between VDDlow and VSS. In an alternative embodiment, a complementary design may be used. For example, an OR gate and a low active enable signal such as enable_bypass_n_VDDlow may be used. Such designs will force the bottom electrode voltage Vcbot to high in case the bypass switch 215 is in OFF state.

The capacitive coupling unit 511 ensures that the gate potential of the bypass switch 215 is tied to the charge pump output Vout. Due to the leakage current Ileakage, the output voltage Vout_filtered of the ripple filter 213 (FIG. 5) is lower than the charge pump output voltage Vout. The bypass switch 215 may be turned off by coupling the gate of the bypass switch 215 to Vout and turned on by lowering the gate potential to a voltage below Vout.

In prior art designs, rather than lowering the gate potential to a voltage below charge pump output voltage (Vout), the gate potential is toggled between the charge pump output voltage (Vout) and ground potential Vss. This results in a large voltage across the gate dielectric of the transistors requiring the use of high voltage transistors. For example, in the illustrated circuit in FIG. 6, the maximum voltage between the source node and the gate node of the transistor 615 or between the drain node and the gate node of the transistor 615 is VDDlow (maximum voltage difference between Vout and Vout_N−1), which is operational low voltage. Therefore, the voltage across the gate dielectric of the transistor 615 toggles between VDDlow and ground. Consequently, in various embodiments, transistor 615 may be a standard CMOS transistor operating at standard voltages (e.g., less than 3.6V).

Figure 7:
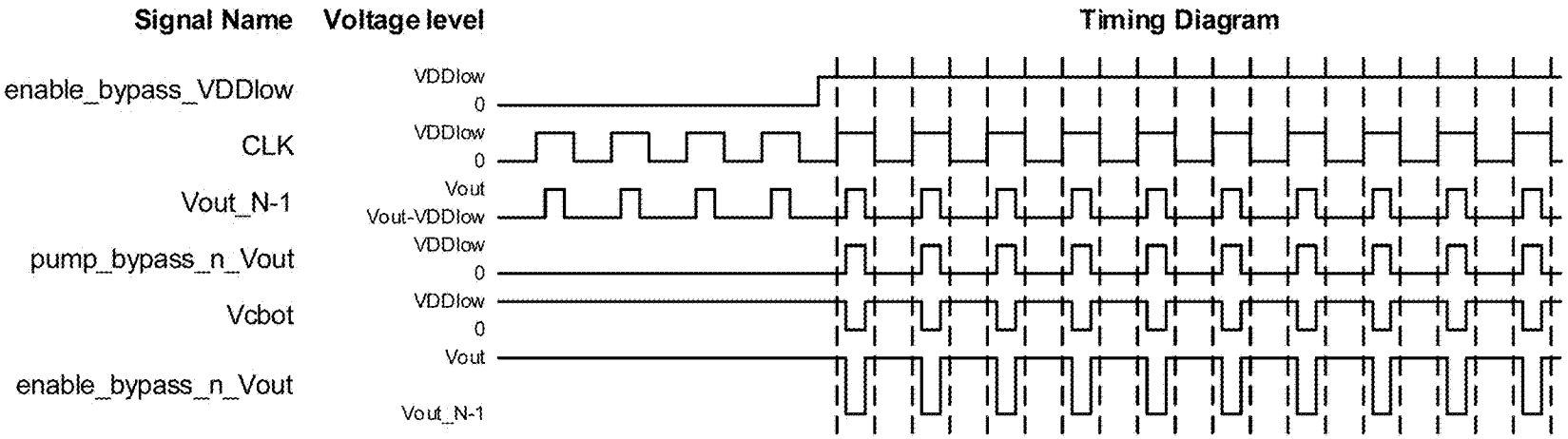
FIG. 7 illustrates a schematic of a timing diagram associated with the operation of the capacitive coupling unit in accordance with embodiment of the present invention.

FIG. 7 illustrates a schematic of a timing diagram associated with the operation of the capacitive coupling unit in accordance with embodiment of the present invention.

Referring to FIG. 7, the clock signal CLK is a periodic signal, e.g., toggling between operational low voltage VDDlow and ground.

The dynamic voltage change at node enable_bypass_n_Vout is generated by toggling the bottom plate voltage Vcbot of coupling capacitance Cac. If the bypass function is disabled using enable_bypass_VDDlow (i.e., enable_bypass_VDDlow='0'), the top-plate of this capacitance and signal enable_bypass_n_Vout is charged to Vout through transistor 615 (e.g., a PMOS transistor) that is controlled by voltage Vout_N−1, which is the voltage of the last pump stage of the charge pump.

At this time phase, the bottom plate voltage Vcbot is at VDDlow and coupling capacitor 617 is charged to (Vout−VDDlow). Subsequently, when the bypass function is enabled (i.e., enable_bypass_VDDlow='1'), then the bottom plate voltage Vcbot of the coupling capacitor 617 toggles between VDDlow and VSS.

Figure 8:
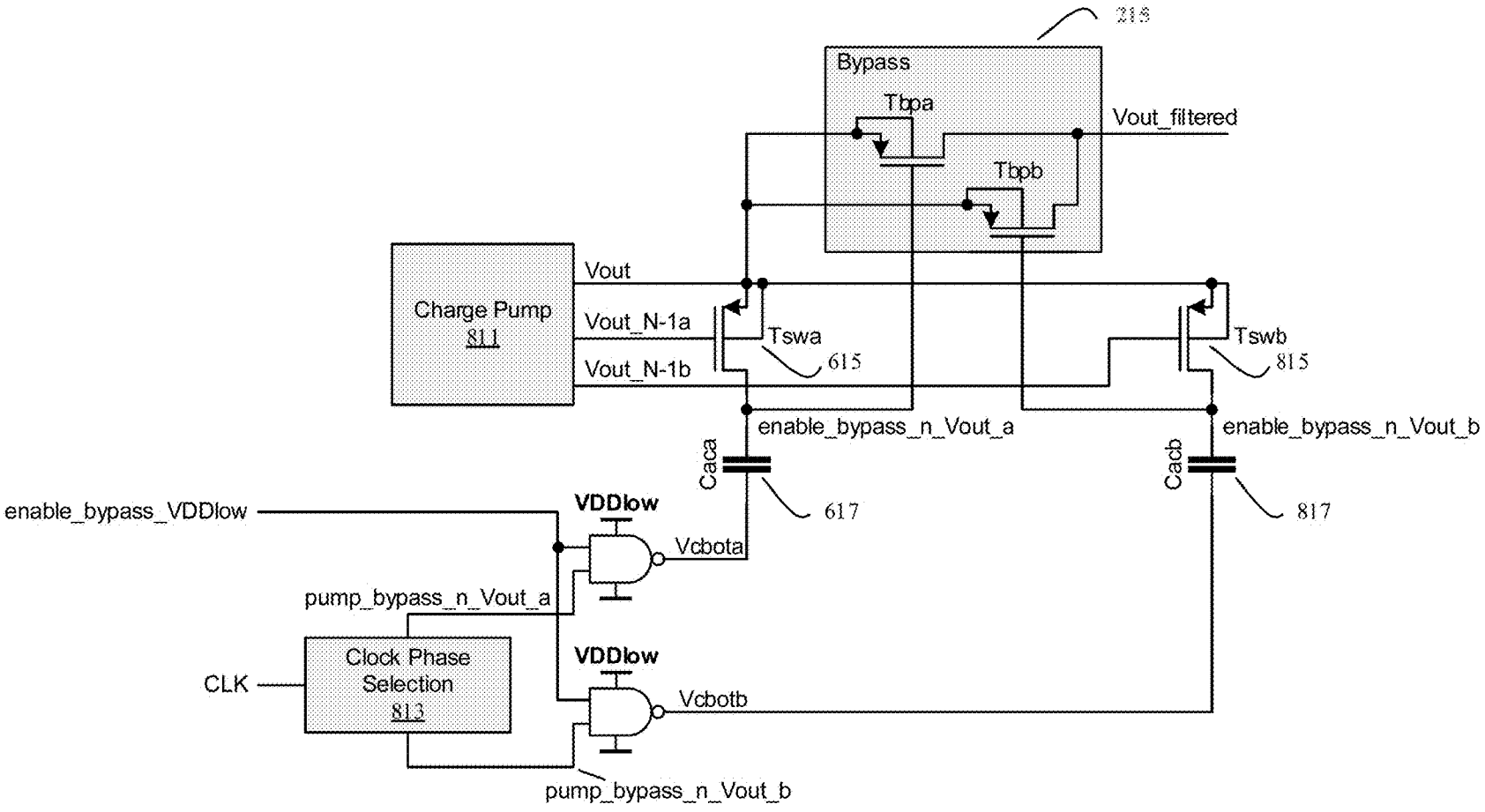
FIG. 8 illustrates a simplified circuit diagram of an implementation of the capacitive coupling unit for two phase charge pump in accordance with embodiment of the present invention.

By proper alignment of the timing of the N−1 stage output Vout_N−1 of the charge pump 211 with the output of the clock phase selector 611 (pump_bypass_n_Vout) that is derived from the master clock, the output node (enable_bypass_n_Vout) of the capacitive coupling circuit 511 is pulled down when Vout_N−1 is pumped up to Vout (transistor 615 Tsw is turned off when Vout_N−1 is pumped up to Vout). In the second half of the clock phase, the transistor 615 is switched on again and the voltage at the output node (enable_bypass_n_Vout) of the capacitive coupling circuit 511 is pulled up to the charge pump output voltage Vout and any charge delivered to the bypass switch can be restored on the coupling capacitor FIG. 8 illustrates a simplified circuit diagram of an implementation of the capacitive coupling unit for two phase charge pump in accordance with embodiment of the present invention.

In the example of a capacitive coupling unit shown in FIG. 6 and the related timing diagram (FIG. 7) a single-phase charge is assumed. Therefore, pumping is performed in only one clock phase. Embodiments of the present invention may be applied to charge pump designs that use both clock phases with non-overlapping clock schemes. Such a design would include additional components corresponding to the NAND gate 613, transistor 615, coupling capacitor 617 and as illustrated in FIG. 8.

Two-phase operation of the capacitive coupling unit 511 is achieved by doubling-up the circuit to include a second coupling capacitor 817 Cac, a second transistor 815 and adding a second NAND gate 813 controlled by a signal that is aligned to the second clock phase. The bypass switch circuit is modified to include a second bypass transistor Tbpb in parallel to the first bypass transistor Tbpa so that each bypass transistor is driven by one selection unit. The advantage of this design is that the on-time of the bypass is doubled almost achieving permanent on time if non-overlapping times in between the clock phases are small compared to the clock period.

In a further alternative embodiment, NMOS devices in triple-well arrangement may be used instead of PMOS devices. In this case, the active-low operation is changed to an active-high scheme but the same principle of operation may be applied. Additional layers are needed for isolation of the NMOS devices due to the triple-well process, which may increase the cost of this option. The additional layers are N+ buried layer to isolate against the p-substrate, a N+ sinker to connect the N+ buried layer, a P-well on top of the N+ buried layer and extra deep body layer to set the base doping for the NMOS devices correctly.

Figure 9A:
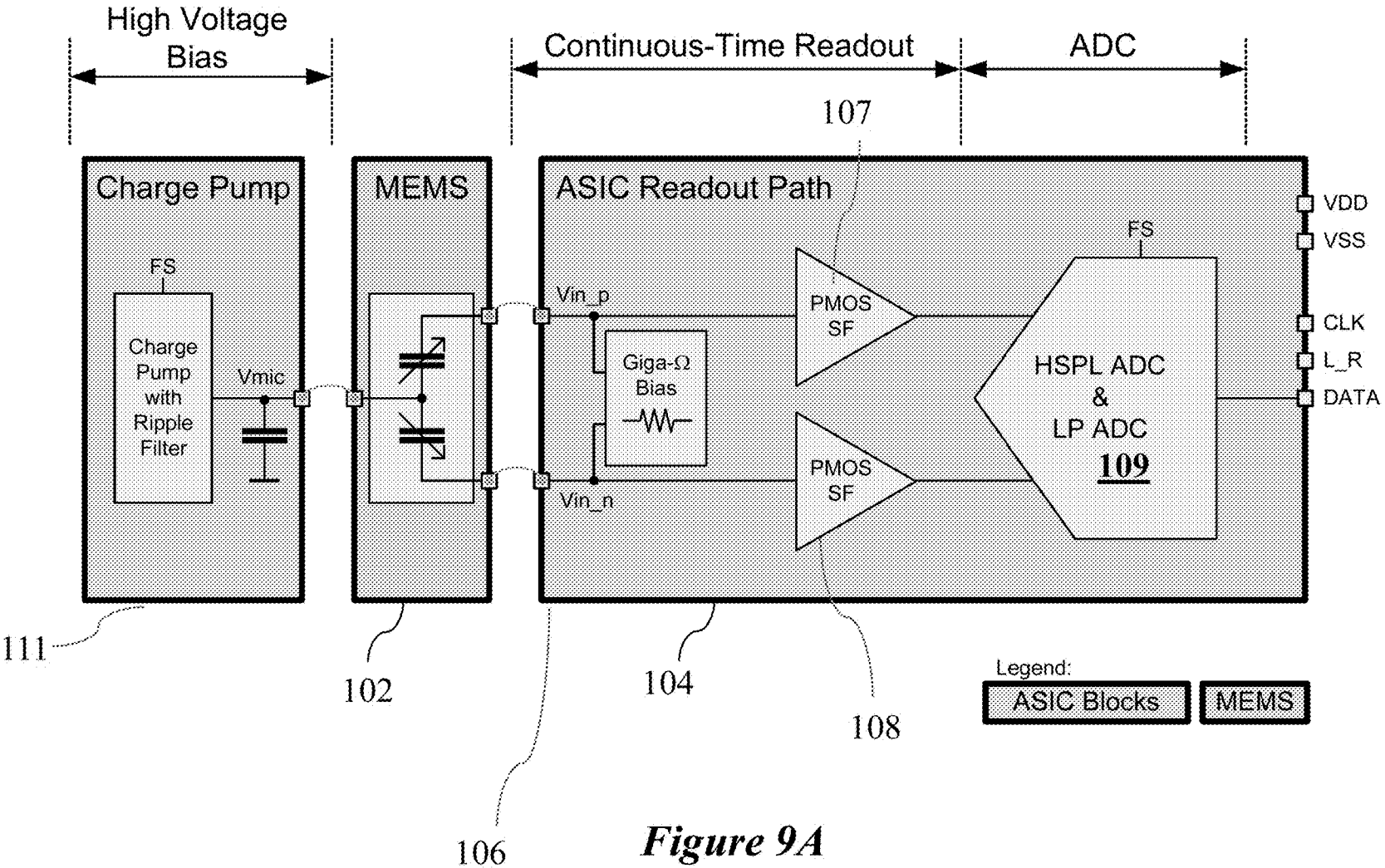
Figure 9B:
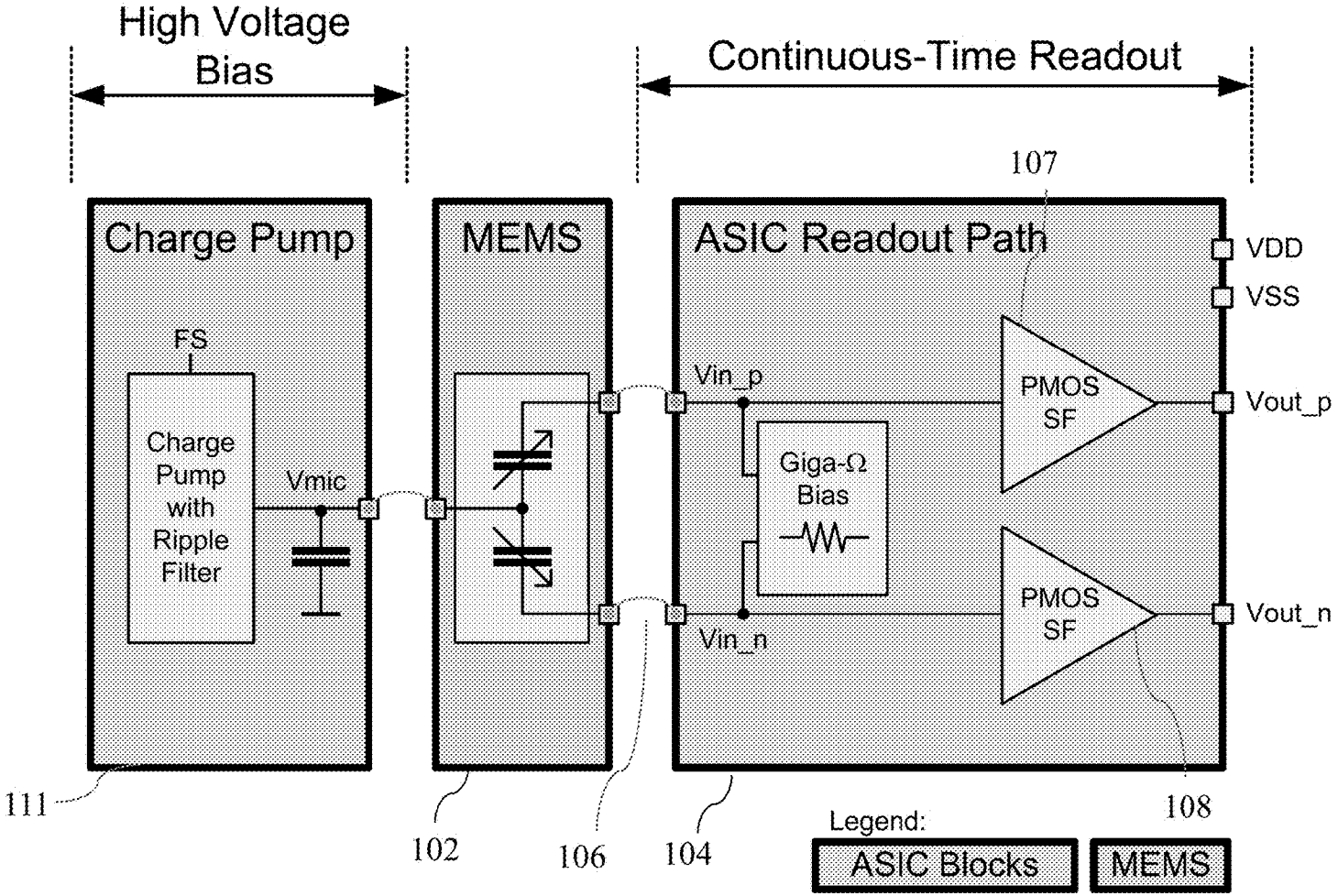

FIGS. 9A and 9B illustrate an embodiment of silicon microphones with MEMS acoustic sensors. FIG. 9A illustrates a digital silicon microphone whereas FIG. 9B illustrates an analog silicon microphone.

Embodiments of the present invention for the bias voltage generator may be applied to all kinds of silicon microphones using MEMS sensors as well as other MEMS devices.

Silicon microphones may be categorized into digital and analog silicon microphones, as illustrated in FIGS. 9A and 9B respectively. On both the embodiments, the ASIC block 104 (an ASIC chip) comprises a high bias voltage generator that produces the bias voltage Vmic for the MEMS capacitor.

As illustrated in FIG. 9B, analog silicon microphones comprise a buffer circuit driving the signal delivered by the MEMS device 105. In the illustrated embodiment, two separate single-ended analog signals are outputted to form a differential analog interface. For example, for detecting a stereo sound, four analog signals are outputted by two analog silicon microphones.

In contrast, a digital silicon microphone performs an A/D conversion on the differential signal driven by the MEMS buffer circuit and outputs a digital signal. Thus, a single digital signal may be outputted by the digital silicon microphone.

Although the above example is illustrated using dual-backplate MEMS sensors and differential implementation, embodiments of the present invention may be applied to other designs such as single-backplate silicon microphones and single-ended implementations. In both cases, capacitive coupling may be used in the high bias voltage generator, e.g., within the charge pump, for steering the bypass of the output ripple filter.

In many applications requiring high voltages, such as silicon microphones, the voltage requirements for the bias voltage Vmic of the MEMS capacitor are not overly high, e.g. up to 15 V. Furthermore, only a small set of configuration bits is sufficient to set the voltage level. The suggested capacitive coupling technique combined with eFuse based non-volatile memory and n-well separation enables selection of standard CMOS technology for such voltage bias generators. For those high-volume products this is an important cost saving factor.

Figure 10:
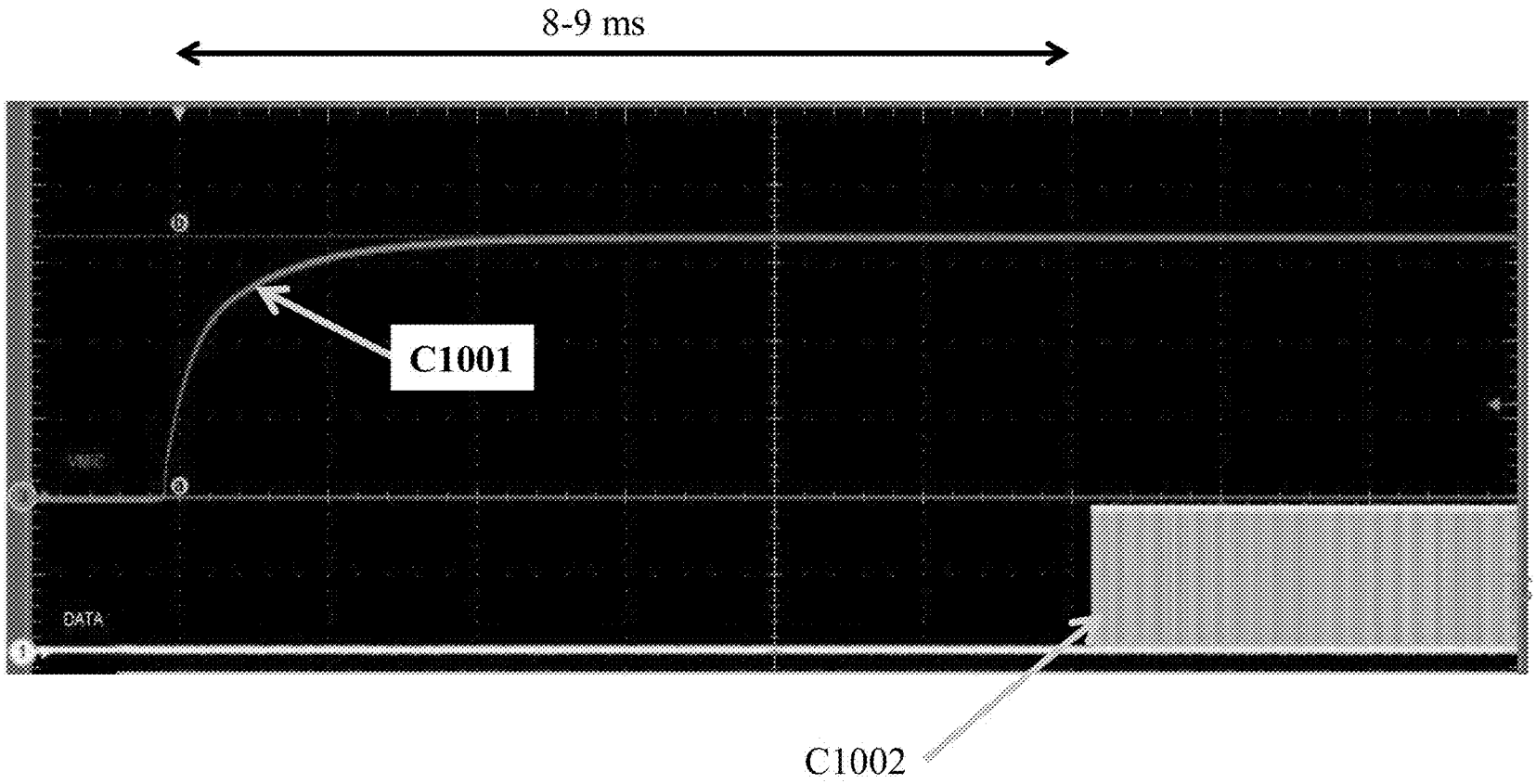
FIG. 10 illustrates a snapshot of measurement results obtained with an implementation of the capacitive coupling principle as described above in various embodiments.

FIG. 10 illustrates an operation of the implementation of the capacitive coupling circuit in accordance with an embodiment of the present invention.

FIG. 10 illustrates a snapshot of measurement results obtained with an implementation of the capacitive coupling principle as described above in various embodiments. The first curve C1001 traces the startup of the charge pump circuit delivering Vmic to the MEMS device. During the startup, the ripple filter bypass is engaged. One millisecond prior to starting the DATA signal (curve 1002), the bypass switch is opened again. As illustrated, the output voltage Vmic is settled prior to the starting of the DATA signal. Further, no disturbance can be observed at Vmic if the bypass is disabled.

Accordingly, in various embodiments, a bypass switch is controlled to steer a high bias voltage generator output ripple filter using capacitive coupling. Further, in various embodiments, the high bias voltage generators uses only standard CMOS technology, which does not offer high-voltage devices capable of withstanding large voltages, for example, greater than 5 V. Accordingly, standard CMOS technology devices do not include thick gate oxides that are needed to withstand gate-source or drain-source voltages greater than 5 V or drain-extended MOSFET devices (DeMOS) capable of taking a drain-source voltages greater 5 V. Devices for performing of input/output operation, e.g., handling up to 3.6 V, which are commonly available in standard CMOS process technology are fully sufficient. Further, in various embodiments, eFuses capable of storing programming codes of the high bias voltage are enabled. Further, metal capacitors such as lateral metal capacitors may be used to perform the capacitive coupling and as pumping capacitors in the charge pump that is part of the bias voltage generator. Embodiments of the present invention use standard CMOS technology for the design of high bias voltage generators and using n-well separation to isolate adjacent n-wells from p-wells to increase the lateral breakdown voltage. Embodiments of the present invention use standard CMOS technology for the design of high bias voltage generators that are used on a silicon microphone (digital/analog/single-ended/differential) to set the bias voltage of the MEMS capacitance(s).

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of operating a voltage generator comprising:
providing a bypass switch to bypass a ripple filter coupled to a power converter;
providing a coupling capacitor comprising a first plate and a second plate, the first plate coupled to a control node of the bypass switch;
receiving a bypass control signal;
toggling the control node of the bypass switch between a first voltage to a second voltage different from the first voltage by toggling the second plate of the coupling capacitor based on the bypass control signal; and
providing a coupling transistor comprising
a first input/output coupled to a first output of the power converter, and
a control node coupled to a second output of the power converter, wherein the second output is a voltage from an intermediate node within the power converter, and wherein a difference between a voltage at the first output and the voltage at the second output is always less than or equal to a maximum voltage of the bypass control signal.

2. The method of claim 1, wherein the second voltage is lower than the first voltage.

3. The method of claim 1, wherein the second voltage is higher than the first voltage.

4. The method of claim 1, wherein toggling the control node of the bypass switch comprises toggling the control node of the bypass switch from the first voltage to the second voltage if the bypass control signal indicates enabling the bypass switch.

5. The method of claim 1, wherein toggling the control node of the bypass switch comprises switching the control node of the bypass switch to the first voltage if the bypass control signal indicates disabling the bypass switch.

6. The method of claim 1, further comprising:
charging a MEMS device coupled to an output of the ripple filter through the bypass switch.

7. The method of claim 6, wherein after charging the MEMS device,
receiving a bypass control signal indicating to disable the bypass switch, and
setting the control node of the bypass switch to the first voltage.

8. The method of claim 1, wherein the toggling the control node of the bypass switch from the first voltage to the second voltage turns on the bypass switch.

9. The method of claim 1, wherein
the coupling transistor further comprises a second input/output, wherein the second input/output is coupled to the first plate of the coupling capacitor.

10. The method of claim 9, wherein the power converter comprises a multi-stage charge pump circuit, wherein the first output of the power converter is an output voltage of the multi-stage charge pump circuit, and wherein the second output of the power converter is an output voltage of an intermediate stage of the multi-stage charge pump circuit to a control node of the coupling transistor.

11. The method of claim 10, wherein the multi-stage charge pump circuit comprises a plurality of n-wells and p-wells or n-wells and n-wells isolated by low doped regions of a substrate.

12. The method of claim 9, wherein toggling the control node of the bypass switch comprises:
applying the first voltage at the first input/output; and
toggling the control node of the coupling transistor between the first voltage and the second voltage, wherein the control node of the coupling transistor is at the first voltage when the second plate is at a first voltage level, and wherein the control node of the coupling transistor is at the second voltage when the second plate is at a second voltage level.

13. The method of claim 1, wherein the coupling capacitor comprises a metal capacitor.

14. The method of claim 13, wherein the metal capacitor is a lateral capacitor, wherein the first plate and the second plate are part of a same metal level.

15. The method of claim 1, further comprising:
reading configuration bits stored in a non-volatile memory comprising eFuses before generating.

16. The method of claim 1, wherein the bypass switch is configured to operate at low voltages.

17. A voltage generator comprising:
a multi-stage charge pump circuit comprising a high voltage output node to output a high voltage, an intermediate voltage output node to output an intermediate voltage, and an input node to receive a standard voltage;
a ripple filter coupled between the high voltage output node of the multi-stage charge pump circuit and an output node of the voltage generator;
a bypass switch coupled to the ripple filter, the bypass switch coupled between the high voltage output node of the multi-stage charge pump circuit and the output node of the voltage generator;
a coupling transistor comprising
a first input/output coupled to the high voltage output node and
a control node coupled to the intermediate voltage output node, wherein a difference between a voltage at the high voltage output node and the voltage at the intermediate voltage output node is always less than or equal to the standard voltage; and
a capacitive coupling circuit to enable and disable the bypass switch, the capacitive coupling circuit being coupled to the multi-stage charge pump circuit in a high voltage regime, and configured to receive a bypass control signal in a low voltage regime.

18. The voltage generator of claim 17, wherein the capacitive coupling circuit and the bypass switch comprise low voltage devices configured to operate at voltages less than 3.6V.

19. The voltage generator of claim 17, wherein all components in the multi-stage charge pump circuit, the ripple filter, the bypass switch, and the capacitive coupling circuit are standard CMOS compatible standard voltage components.

20. The voltage generator of claim 17, wherein the capacitive coupling circuit comprises a coupling capacitor coupled to a control node of the bypass switch.

21. The voltage generator of claim 20, wherein the coupling capacitor comprises a metal capacitor.

22. The voltage generator of claim 21, wherein the metal capacitor comprises a first metal line and a second metal line disposed in a same metallization level.

23. The voltage generator of claim 17, wherein the multi-stage charge pump circuit comprises metal capacitors.

24. The voltage generator of claim 17, wherein the multi-stage charge pump circuit comprises a Dickson charge pump.

25. The voltage generator of claim 17, wherein the coupling transistor further comprises a second input/output coupled to a control node of the bypass switch; and a coupling capacitor coupled to the control node of the bypass switch.

26. The voltage generator of claim 25, wherein the ripple filter, the bypass switch, and the coupling transistor comprise standard CMOS devices.

27. An electronic device comprising:

a voltage generator configured to output a voltage higher than a supply voltage at an output node, wherein all devices in the voltage generator comprise standard CMOS devices, and wherein the voltage generator comprises a coupling transistor comprising an input/output node and a control node, a power converter circuit comprising a high voltage output node coupled to the input/output node and an intermediate voltage output node coupled to the control node, a bypass switch coupled between the high voltage output node of the power converter circuit and the output node of the voltage generator, and a capacitive coupling circuit comprising a coupling capacitor to enable and disable the bypass switch, the capacitive coupling circuit being coupled to the power converter circuit and configured to receive a bypass control signal, wherein a difference between a voltage at the high voltage output node and the voltage at the intermediate voltage output node is always less than or equal to a maximum voltage of the bypass control signal; and a MEMS microphone coupled to the output node of the voltage generator.

28. The device of claim 27, wherein the voltage generator further comprises a ripple filter coupled to the high voltage output node of the power converter circuit, the ripple filter coupled to the output node of the voltage generator, and wherein the bypass switch is coupled to the ripple filter.

29. The device of claim 28, further comprising:

a buffer for receiving, attenuating, and/or amplifying data signals from the MEMS microphone.

30. The device of claim 29, further comprising an analog to digital (A/D) converter to convert the data signals received from the MEMS microphone to digital domain.

31. The device of claim 28, further comprising a non-volatile memory comprising eFuse for storing configuration data of the MEMS microphone.

* * * * *